US010480053B2

(12) United States Patent
Moon et al.

(10) Patent No.: US 10,480,053 B2
(45) Date of Patent: Nov. 19, 2019

(54) AUSTENITIC LIGHT-WEIGHT HIGH-STRENGTH STEEL WITH EXCELLENT PROPERTIES OF WELDS, AND METHOD OF MANUFACTURING THE SAME

(71) Applicant: KOREA INSTITUTE OF MACHINERY AND MATERIALS, Daejeon (KR)

(72) Inventors: Joon-Oh Moon, Changwon-si (KR); Seong-Jun Park, Changwon-si (KR); Chang-Hoon Lee, Changwon-si (KR)

(73) Assignee: KOREA INSTITUTE OF MACHINERY AND MATERIALS, Daejeon (KR)

( * ) Notice: Subject to any disclaimer, the term of this patent is extended or adjusted under 35 U.S.C. 154(b) by 919 days.

(21) Appl. No.: 14/951,400

(22) Filed: Nov. 24, 2015

(65) Prior Publication Data

US 2016/0153077 A1 Jun. 2, 2016

(30) Foreign Application Priority Data

Nov. 27, 2014 (KR) ..... 10-2014-0167660

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C21D 8/02*** | (2006.01) |
| ***C21D 8/00*** | (2006.01) |
| ***C21D 6/00*** | (2006.01) |
| ***C21D 6/02*** | (2006.01) |
| ***C22C 38/38*** | (2006.01) |

(52) U.S. Cl.

CPC ..... *C22C 38/12* (2013.01); *C21D 6/005* (2013.01); *C21D 6/02* (2013.01); *C21D 8/005* (2013.01); *C21D 8/0205* (2013.01); *C21D 8/0226* (2013.01); *C21D 8/0263* (2013.01); *C22C 38/04* (2013.01); *C22C 38/06* (2013.01); *C22C 38/38* (2013.01); *C21D 2211/001* (2013.01)

(58) Field of Classification Search

CPC ..... C21D 8/005; C21D 8/02; C22C 38/02; C22C 38/04; C22C 38/06; C22C 38/12

USPC ..... 148/620

See application file for complete search history.

(56) References Cited

U.S. PATENT DOCUMENTS

2009/0010793 A1* 1/2009 Becker ..... C21D 6/005 420/38
2014/0007992 A1* 1/2014 Balichev ..... B22D 11/0622 148/546

FOREIGN PATENT DOCUMENTS

DE 102005057599 * 6/2007
GB 2220674 * 1/1990
JP 2006118000 A 5/2006

(Continued)

*Primary Examiner* — Brian D Walck
(74) *Attorney, Agent, or Firm* — Hauptman Ham, LLP

(57) ABSTRACT

The present invention relates to an austenitic light-weight high-strength steel with excellent properties of welds, and a method of manufacturing the same, the method including: (a) hot-rolling a steel including 20 wt % to 30 wt % of manganese (Mn), 6 wt % to 12 wt % of aluminum (Al), 0.6 wt % to 1.5 wt % of carbon (C), 0.3 wt % to 0.95 wt % of vanadium (V), and a remaining amount of iron (Fe) and other unavoidable impurities; (b) homogenizing the hot-rolled steel; and (c) aging the homogenized steel.

4 Claims, 4 Drawing Sheets

(56) References Cited

FOREIGN PATENT DOCUMENTS

| | | | |
|---|---|---|---|
| KR | 1992001631 | B1 | 2/1992 |
| KR | 1020140085088 | A | 7/2014 |

* cited by examiner

AUSTENITIC LIGHT-WEIGHT HIGH-STRENGTH STEEL WITH EXCELLENT PROPERTIES OF WELDS, AND METHOD OF MANUFACTURING THE SAME

CROSS-REFERENCE TO RELATED APPLICATIONS

This application claims the benefit of Korean Patent Application No. 10-2014-0167660, filed on Nov. 27, 2014, entitled "AUSTENITIC LIGHT-WEIGHT HIGH-STRENGTH STEEL WITH EXCELLENT PROPERTIES OF WELDS, AND METHOD OF MANUFACTURING THE SAME", which is hereby incorporated by reference in its entirety into this application.

BACKGROUND

1. Technical Field

The present invention relates to an austenitic light-weight high-strength steel, and more particularly, to an austenitic light-weight high-strength steel with excellent properties of welds, and a method of manufacturing the same.

2. Description of the Related Art

Recently, greenhouse gas emission regulation policy has been reinforced as an interest in environmental pollution is globally increased. In addition, in accordance with demand of consumers for improving fuel efficiency according to an increase in oil price, demand for developing light-weight steel material has been increased.

In accordance with the demand, in the steel industry, TWin Induced Plasticity (TWIP) steel was developed by adding a large amount of aluminum (Al) which is a light-weight element relative to the existing steel material, for weight lightening. However, when aluminum (Al) has an amount of 5 wt % or more in the TWIP steel, the TWIP steel has a limitation in weight lightening since stacking fault energy of the steel is increased to inhibit twin deformation.

Meanwhile, as a high-aluminum light-weight steel including aluminum having an amount of 5 wt % or more, austenitic steel is a representative example.

The austenitic steel is generally classified into austenitic steel consisting of austenite, ferrite, and carbides and austenitic steel consisting of austenite and carbides. Among them, the austenitic steel consisting of austenite, ferrite, and carbides has a problem with deterioration in elongation according to the presence of ferrite, and the austenitic steel consisting of austenite and carbides has a problem with deterioration in properties of welds according to austenite crystal grain growth despite excellent properties of a basic material.

As a document regarding the present invention, Korean Patent Laid-Open Publication No. 10-2014-0085088 (Jul. 7, 2014) discloses a high specific strength steel sheet with excellent ductility and a method of manufacturing the same.

The Patent document describes a steel sheet including 0.15 wt % to 0.5 wt % of C, 6.0 wt % to 8.0 wt % of Mn, 5.0 wt % to 6.0 wt % of Al, 0.05 wt % to 0.5 wt % of Si, less than 0.02 wt % of S, and a remaining amount of Fe and other unavoidable impurities, wherein yield strength is 600 MPa or more, and a value obtained by multiplying tensile strength and elongation is 28,000 MPa·% or more.

However, this steel sheet has a limitation in weight lightening since the maximum amount of aluminum (Al) is merely 6 wt %, and has difficulty in securing sufficient fraction of austenite since the maximum amount of manganese (Mn) is also merely 8 wt %.

SUMMARY

It is an aspect of the present invention to provide a method of manufacturing an austenitic light-weight high-strength steel with excellent properties of welds.

It is another aspect of the present invention to provide an austenitic light-weight high-strength steel with excellent properties of welds.

In accordance with one aspect of the present invention, a method of manufacturing an austenitic light-weight high-strength steel includes: (a) hot-rolling a steel including 20 wt % to 30 wt % of manganese (Mn), 6 wt % to 12 wt % of aluminum (Al), 0.6 wt % to 1.5 wt % of carbon (C), 0.3 wt % to 0.95 wt % of vanadium (V), and a remaining amount of iron (Fe) and other unavoidable impurities; (b) homogenizing the hot-rolled steel; and (c) aging the homogenized steel.

The steel may further include 0.02 wt % to 0.06 wt % of niobium (Nb).

A total amount of niobium and vanadium (Nb+V) may be 0.35 wt % to 0.95 wt %.

Step (a) may include: hot-rolling the steel under a finish rolling temperature condition of 900° C. or more, and cooling the steel up to 600° C. or less, at an average cooling rate of 10° C./sec or more.

Step (b) may include: homogenizing the hot-rolled steel at 1000° C. to 1200° C. for 1 to 3 hours, and cooling the steel up to 600° C. or less, at an average cooling rate of 10° C./sec or more.

Step (c) may include: aging the homogenized steel at 550±10° C. for 10 minutes or more, and cooling the steel up to 200° C. or less, at an average cooling rate of 10° C./sec or less.

In accordance with another aspect of the present invention, an austenitic light-weight high-strength steel includes: 20 wt % to 30 wt % of manganese (Mn), 6 wt % to 12 wt % of aluminum (Al), 0.6 wt % to 1.5 wt % of carbon (C), 0.3 wt % to 0.95 wt % of vanadium (V), and a remaining amount of iron (Fe) and other unavoidable impurities, wherein the steel has a fine structure including austenite and carbide, and tensile strength of a weld heat-affected zone after welding is 80% or more relative to strength of a basic material.

The austenitic light-weight high-strength steel may further include 0.02 wt % to 0.06 wt % of niobium (Nb). In this case, a total amount of niobium and vanadium may be 0.35 wt % to 0.95 wt %, and in this case, tensile strength may be 900 MPa or more, yield strength may be 650 MPa or more, and elongation may be 40% or more.

DETAILED DESCRIPTION

Figure 1:
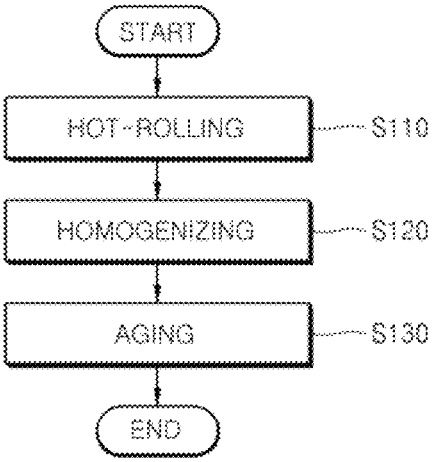
FIG. 1 is a flow chart schematically illustrating a method of manufacturing an austenitic light-weight high-strength steel according to an exemplary embodiment of the present invention.

Hereinafter, an austenitic light-weight high-strength steel with excellent properties of welds according to the present invention, and a method of manufacturing the same, are described in detail with reference to the accompanying drawings.

The austenitic light-weight high-strength steel with excellent properties of welds according to the present invention includes 20 wt % to 30 wt % of manganese (Mn), 6 wt % to 12 wt % of aluminum (Al), 0.6 wt % to 1.5 wt % of carbon (C), and 0.3 wt % to 0.95 wt % of vanadium (V).

In addition, the austenitic light-weight high-strength steel according to the present invention preferably further includes 0.02 wt % to 0.06 wt % of niobium (Nb).

In addition to the above-described components, the austenitic light-weight high-strength steel includes a remaining amount of iron (Fe) and other unavoidable impurities.

Alloy components of the austenitic light-weight high-strength steel according to the present invention is deduced to overcome problems such as limitation in elongation due to formation of ferrite, limitation in elongation due to formation of β—Mn phase, deterioration of tensile strength due to crystal grain growth in welds, and the like. Hereinafter, role and amount of each component included in the austenitic light-weight high-strength steel according to the present invention are described.

Manganese (Mn)

Manganese (Mn) is an austenite stabilizing element, and needs to have an amount of 20 wt % or more relative to total weight of the steel in order to manufacture an austenitic light-weight high-strength steel having a fine structure close to an austenite single phase.

Meanwhile, when an amount of manganese is more than 30 wt %, which is excessive, the formation of β—Mn phase reduces elongation. Therefore, in the present invention, the amount of manganese is limited to be 30 wt % or less relative to total weight of the steel.

Aluminum (Al)

Aluminum (Al) is an essential element for weight lightening, and has an amount of 6 wt % or more relative to total weight of the steel in order to increase a light-weight effect.

Meanwhile, aluminum is ferrite stabilizing element, and when an amount of aluminum is more than 12 wt %, which is excessive, the formation of austenite phase may be interfered, and elongation may be reduced by the formation of ferrite, and therefore, in the present invention, the amount of aluminum is limited to be 12 wt % or less relative to total weight of the steel.

Carbon (C)

Carbon (C) is a strong austenite stabilizing element, and is required for manufacturing an austenitic light-weight high-strength steel, and is effective for increasing tensile strength due to an effect of enhancing solidification.

The carbon preferably has an amount of 0.6 wt % to 1.5 wt % relative to total weight of the steel. When the amount of carbon is less than 0.6 wt %, an effect obtained by adding carbon is not sufficient. On the other hand, when the amount of carbon is more than 1.5 wt %, elongation may be reduced due to formation of excessive carbides, and may cause crack at the time of rolling.

Vanadium (V)

Vanadium (V) is a strong carbide forming element and is effective for increasing tensile strength according to enhancement of precipitation.

The vanadium preferably has an amount of 0.3 wt % to 0.95 wt % relative to total weight of the steel. When the amount of vanadium is less than 0.3 wt %, an effect obtained by adding vanadium is not sufficient. On the other hand, when the amount of vanadium is more than 0.95 wt %, formation of coarse precipitates is promoted, such that the effect of enhancing precipitation may be inhibited, and elongation may be largely reduced.

Niobium (Nb)

Niobium (Nb) is a strong carbide forming element together with vanadium (V), and is effective for increasing tensile strength according to enhancement of precipitation. Further, niobium forms precipitates being stable at a high temperature, thereby inhibit the crystal grain growth in the weld heat-affected zone to prevent deterioration of properties of welds.

When the steel includes niobium, the niobium preferably has an amount of 0.02 wt % to 0.06 wt % relative to total weight of the steel. When the amount of niobium is less than 0.02 wt %, an effect obtained by adding niobium is not sufficient. On the other hand, when the amount of niobium is more than 0.06 wt %, formation of precipitates is promoted, such that the effect of enhancing precipitation may be rather reduced.

Meanwhile, when the steel includes niobium having the above preferable amount, a total amount of niobium and vanadium is more preferably 0.35 wt % to 0.95 wt % relative to total weight of the steel. It is because when the total amount of niobium and vanadium satisfies the above-described range, tensile strength may be 900 MPa or more and elongation may be 40% or more. Meanwhile, when the total amount of niobium and vanadium is more than 0.95 wt %, which is excessive, elongation may be reduced.

Sulfur (S), Phosphorus (P)

Sulfur (S) and phosphorus (P) are factors causing segregation in manufacturing steel, which deteriorates toughness and ductility of the steel. In addition, sulfur is bound to manganese (Mn), thereby forming MnS inclusion, which deteriorates ductility.

Therefore, the most preferably, sulfur and phosphorus are not included, and in the case in which sulfur and phosphorus are included as impurities, it is preferable to limit amounts of sulfur (S) and phosphorus (P) to be 0.01 wt % or less and 0.02 wt % or less, respectively.

The austenitic light-weight high-strength steel including the above-described alloy components according to the present invention has a fine structure including austenite and carbides according to a manufacturing process to be described below. Here, the steel includes 90% or more of austenite in an area ratio. Further, the carbides include κ-carbide produced by the aging process, and precipitates formed by adding vanadium and niobium.

Further, in the austenitic light-weight high-strength steel according to the present invention, tensile strength of a weld heat-affected zone after welding may be 80% or more relative to strength of a basic material, such that excellent properties of welds may be exhibited.

In addition, when the total amount of niobium and vanadium is 0.35 wt % to 0.95 wt % in the austenitic light-weight high-strength steel according to the present invention, tensile strength of 900 MPa or more, yield strength of 650 MPa or more, and high elongation of 40% or more may be exhibited.

Hereinafter, a method of manufacturing an austenitic light-weight high-strength steel with excellent properties of welds according to the present invention is described.

FIG. 1 is a flow chart schematically illustrating a method of manufacturing an austenitic light-weight high-strength steel according to an exemplary embodiment of the present invention.

The method of manufacturing an austenitic light-weight high-strength steel according to the present invention may include hot-rolling (S110), homogenizing (S120), and aging (S130).

First, in the hot-rolling (S110), a steel including 20 wt % to 30 wt % of manganese (Mn), 6 wt % to 12 wt % of aluminum (Al), 0.6 wt % to 1.5 wt % of carbon (C), 0.3 wt % to 0.95 wt % of vanadium (V), and a remaining amount of iron (Fe) and other unavoidable impurities is subjected to hot-rolling and cooling.

Here, as described above, the steel may further include 0.02 wt % to 0.06 wt % of niobium (Nb), and in this case, a total amount of niobium and vanadium is preferably 0.35 wt % to 0.95 wt %.

The steel may be re-heated at about 1150° C. to 1250° C. for 1 to 3 hours before the hot-rolling.

More specifically, the hot-rolling may include hot-rolling the steel under a finish rolling temperature condition of 900° C. or more, more preferably, 900° C. to 1000° C., and cooling the steel up to 600° C. or less, preferably, 600° C. to 400° C., at an average cooling rate of 10° C./sec or more, preferably, 10 to 200° C./sec. When the finish rolling temperature is less than 900° C., abnormal grains may be mixed. In addition, when the average cooling rate is less than 10° C./sec, a large amount of coarse carbides may be formed at the time of cooling. Further, when a cooling end temperature is more than 600° C., a large amount of coarse carbides may be formed. The cooling in the present step is preferably water-cooling.

Next, in the homogenizing (S120), the hot-rolled steel is homogenized.

More specifically, the homogenizing (S120) may include homogenizing the hot-rolled steel at 1000° C. to 1200° for 1 to 3 hours, and cooling the steel up to 600° C. or less, more preferably, room temperature, at an average cooling rate of 10° C./sec or more, preferably, 10 to 200° C./sec. When a temperature for the homogenizing is less than 1000° C., an effect obtained by the homogenizing is not sufficient, and when the temperature for the homogenizing is more than 1200° C., toughness and ductility may be deteriorated due to coarse crystal grains. Further, when the average cooling rate is less than 10° C./sec after the homogenizing, a large amount of coarse carbide may be formed at the time of cooling. Further, when a cooling end temperature is more than 600° C., a large amount of coarse carbides may be formed. The cooling in the present step is preferably water-cooling.

Next, in the aging (S130), the homogenized steel is subjected to aging. By the aging, strength may be improved, and fine κ-carbide may be formed to improve mechanical properties of the steel.

The aging may include aging the homogenized steel at 550±10° C. for 10 minutes or more, and cooling the steel up to 200° C. or less, more preferably, room temperature, at an average cooling rate of 10° C./sec or less. When a temperature of the aging is less than 540° C., an effect obtained by the aging is not sufficient, and when a temperature of the aging is more than 560° C., properties may be deteriorated due to precipitation of crystal grains. Further, when the cooling is performed an average cooling rate of more than 10° C./sec after the aging, properties of the steel may be deteriorated. The cooling in the present step is preferably air-cooling.

Example

Hereinafter, constitution and function of the present invention will be described in more detail through preferable exemplary embodiments of the present invention. Meanwhile, these exemplary embodiments are provided by way of example, and accordingly, it should not be interpreted as limiting the scope of the present invention. Descriptions which are not described in the specification can be sufficiently and technically deduced by a person skilled in the technical field, and accordingly, details thereof will be omitted.

1. Manufacture of Sample

Each ingot having chemical composition shown in Table 1 was manufactured in a vacuum induction melting furnace. Each ingot was re-heated at 1200° C. for 2 hours, followed by hot-rolling under a finish rolling temperature condition of 920° C., and water-cooling up to 550° at an average cooling rate of 50° C./sec, and then air-cooling up to room temperature, thereby manufacturing a steel sheet having a thickness of 4 mm. Then, the steel sheet was homogenized at 1050° C. for 2 hours, and water-cooled up to room temperature at a cooling rate of 20° C./sec. Then, the steel sheet was subjected to aging at 550° C. for 1000 minutes, and air-cooled up to room temperature. In the developed steels as compared to the existing steel, carbides that are stable at high temperature were formed by adding vanadium and niobium, respectively, to inhibit austenite crystal grain growth, and accordingly, light-weight steels in which properties of a basic material and welds are excellent were manufactured.

TABLE 1

(Unit: wt %)

| Classification | C | Mn | Al | V | Nb | Fe |
|---|---|---|---|---|---|---|
| Sample 1 (Existing Steel) | 0.9 | 30 | 9 | — | — | Remaining amount |
| Sample 2 (Developed Steel 1) | 0.9 | 30 | 9 | 0.5 | — | Remaining amount |
| Sample 3 (Developed Steel 2) | 0.9 | 30 | 9 | 0.5 | 0.04 | Remaining amount |
| Sample 4 (Compared Steel) | 0.9 | 30 | 9 | 1.0 | — | Remaining amount |

2. Evaluation of Properties

A tensile test was performed on samples 1 to 4, and results thereof were shown in Table 2.

TABLE 2

| Classification | Tensile Strength (MPa) | Yield Strength (MPa) | Elongation (%) |
|---|---|---|---|
| Development Objective | ≥900 | ≥650 | ≥40 |
| Sample 1 (Existing Steel) | 892 | 654 | 53 |
| Sample 2 (Developed Steel 1) | 921 | 681 | 43 |
| Sample 3 (Developed Steel 2) | 992 | 667 | 44 |
| Sample 4 (Compared Steel) | 935 | 655 | 29 |

As confirmed in Table 2, it may be appreciated that as compared to the existing steel, the developed steels had high strength.

In particular, in samples 2 and 3 in which a total amount of niobium and vanadium is 0.35 wt % to 0.95 wt %, both of strength and elongation were excellent, but in sample 4 (compared steel) in which more than 0.95 wt % of vanadium is added, elongation was below the target value.

In addition, in sample 3 in which niobium and vanadium are simultaneously added, tensile strength was improved by 100 MPa as compared to sample 1.

Figure 2:
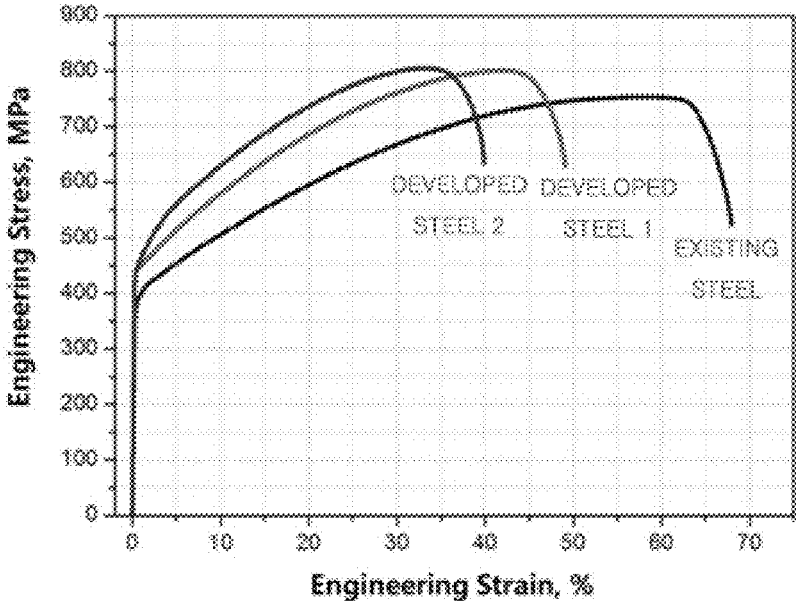
FIG. 2 illustrates tensile test results of weld heat-affected zone of developed steels 1 and 2 and existing steel.

FIG. 2 and Table 3 show tensile test results of each weld heat-affected zone of the developed steels 1 and 2 and the existing steel.

In order to confirm properties of welds of the developed steels as compared to the existing steel, the weld heat-affected zone was implemented by using Gleeble simulator, wherein heat input was implemented to be 300 kJ/cm.

TABLE 3

| Classification | Tensile Strength (MPa) | Yield Strength (MPa) | Elongation (%) |
|---|---|---|---|
| Sample 1 (Existing Steel) | 754 | 377 | 68 |
| Sample 2 (Developed Steel 1) | 801 | 441 | 49 |
| Sample 3 (Developed Steel 2) | 806 | 443 | 40 |

Referring to FIG. 2 and Table 3, it was confirmed that as compared to the existing steel, the developed steels exhibited excellent tensile properties of the weld heat-affected zone, and the sample 3 in which niobium and vanadium are simultaneously added had the highest tensile strength and yield strength. These results come from the carbides such as NbC, (Nb,V)C, VC, and the like, formed by further adding niobium, vanadium, and the like, to thereby contribute to strength, in addition to κ-carbide which contribute to strength in the existing light-weight steel.

Meanwhile, the present invention has an object of providing a light-weight steel in which a weld heat-affected zone has strength of 80% or more relative to a basic material. As confirmed in Tables 2 and 3, in the existing steel, the yield strength of the weld heat-affected zone was largely reduced to be 80% or less relative to that of the basic material. Meanwhile, in the developed steels, both of the tensile strength and the yield strength of the weld heat-affected zone were 80% or more relative to those of the basic material, thereby satisfying the target values.

Figure 3:
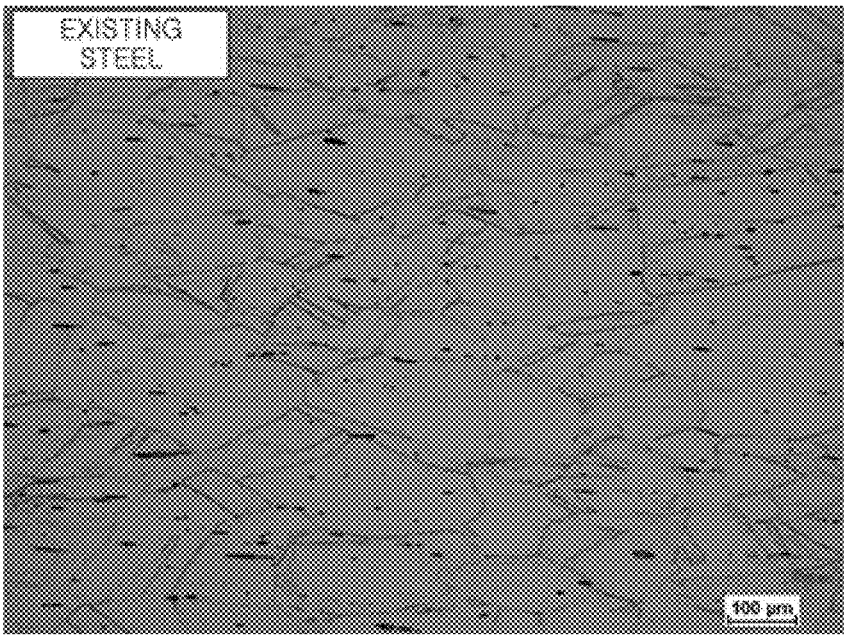
FIG. 3 illustrates a fine structure of the weld heat-affected zone of the existing steel.
Figure 4:
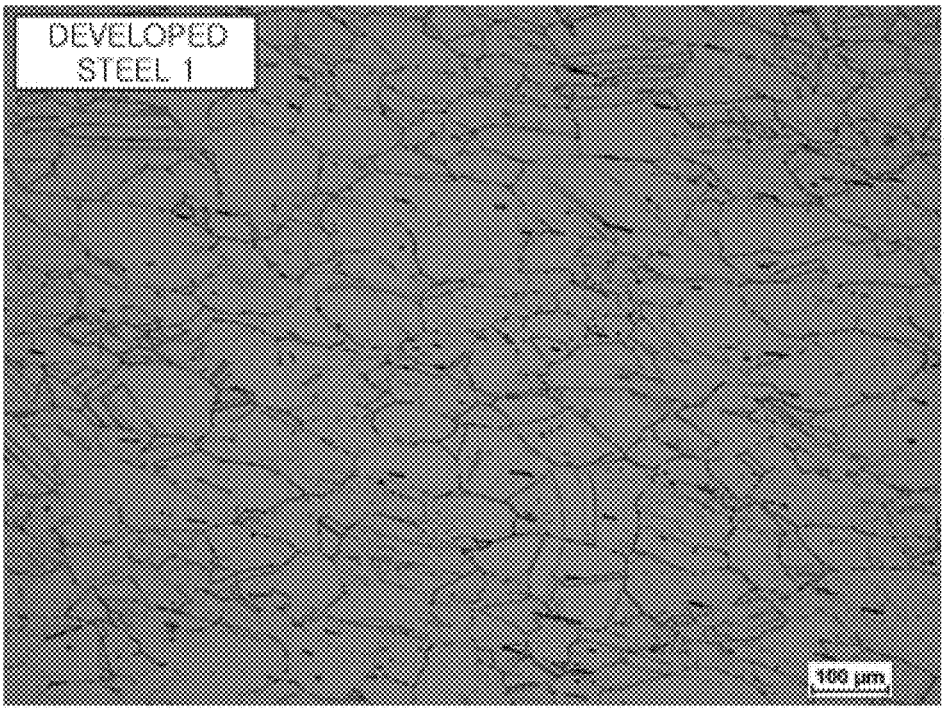
FIG. 4 illustrates a fine structure of the weld heat-affected zone of the developed steel 1.

FIG. 3 illustrates a fine structure of the weld heat-affected zone of the existing steel, and FIG. 4 illustrates a fine structure of the weld heat-affected zone of the developed steel 1.

As illustrated in FIGS. 3 and 4, as compared to the existing steel, the developed steel had a fine crystal grain size, which is because VC precipitates which are stable at a high temperature are formed by adding 0.5 wt % of vanadium, and due to the VC precipitates, the crystal grain growth at a high temperature is inhibited. The fine crystal grain may be considered as another factor for improving the strength of the weld heat-affected zone of Table 3 in addition to the effect of enhancing precipitation.

According to the method of manufacturing an austenitic light-weight high-strength steel of the present invention, crystal grain growth of a weld heat-affected zone may be inhibited by adding carbide forming elements such as V, Nb, and the like, to the Fe—C—Mn—Al alloy (Fe, C, Mn and Al are basic components of a light-weight steel), thereby forming precipitates such as VC, NbC, (Nb,V)C, and the like. Accordingly, the austenitic light-weight steel with excellent properties in which strength is 80% or more relative to the basic material, is capable of being manufactured.

Further, the austenitic light-weight high-strength steel according to the present invention may have 900 MPa or more of tensile strength, 650 MPa or more of yield strength, and 40% of elongation by adding an appropriate amount of each of niobium and vanadium, thereby having high formability and high strength.

Although the exemplary embodiments of the present invention have been described, various changes and modifications can be made by those skilled in the art without the scope of the appended claims of the present invention. Such changes and modifications should also be understood to fall within the scope of the present invention. Therefore, the protection scope of the present invention should be determined by the appended claims to be described below.

What is claimed is:

1. A method of manufacturing an austenitic steel, the method comprising:

hot-rolling a steel including 20 wt % to 30 wt % of manganese (Mn), 6 wt % to 12 wt % of aluminum (Al), 0.6 wt % to 1.5 wt % of carbon (C), 0.3 wt % to 0.95 wt % of vanadium (V), and a remaining amount of iron (Fe) and other unavoidable impurities;

homogenizing the hot-rolled steel; and aging the homogenized steel, wherein hot-rolling the steel comprises:

hot-rolling the steel under a finish rolling temperature ranging from 900° C. to 1000° C.; and cooling the steel to 600° C. or less, wherein cooling the steel comprises cooling the steel at an average cooling rate ranging from 10° C./sec to 50° C./sec, and wherein aging the homogenized steel comprises:

aging the homogenized steel at a temperature ranging from 540° C. to 560° C. for 10 minutes or more; and cooling the steel to a temperature of 200° C. or less, at an average cooling rate of 10° C./sec or less.

2. The method of claim 1, wherein the steel further includes 0.02 wt % to 0.06 wt % of niobium (Nb).

3. The method of claim 2, wherein a total amount of niobium and vanadium is 0.35 wt % to 0.95 wt %.

4. The method of claim 1, wherein homogenizing the hot-rolled steel comprises:

homogenizing the hot-rolled steel at a temperature ranging from 1000° C. to 1200° C. for a time ranging from 1 to 3 hours; and cooling the steel to a temperature of 600° C. or less, at an average cooling rate of 10° C./sec or more.

* * * * *